United States Patent [19]

Fisher et al.

[11] 4,119,501

[45] Oct. 10, 1978

[54] ELECTROPLATING NICKEL USING ANODES OF FLATTENED NICKEL FORMS

[75] Inventors: Gordon Lloyd Fisher, Mahwah, N.J.; Ernest Lee Huston, Suffern, N.Y.

[73] Assignee: The International Nickel Company, Inc., New York, N.Y.

[21] Appl. No.: 830,644

[22] Filed: Sep. 6, 1977

[51] Int. Cl.[2] ..... C25D 3/12; C25D 17/12

[52] U.S. Cl. ..... 204/49; 29/420; 204/292

[58] Field of Search ..... 204/292, 49, 259, 286, 204/297 R; 29/420, DIG. 31; 75/214

[56] References Cited

U.S. PATENT DOCUMENTS

| | | | |
|---|---|---|---|
| 3,099,080 | 7/1963 | Worn | 29/420 |
| 3,131,472 | 5/1964 | Turner | 29/528 |
| 3,220,875 | 11/1965 | Queneau | 117/100 |
| 3,270,409 | 9/1966 | Grant | 29/420 X |
| 3,536,477 | 10/1970 | Flint et al. | 75/0.5 |
| 3,577,330 | 5/1971 | Knapp et al. | 204/112 |
| 4,041,742 | 8/1977 | Rozmus | 29/420 X |

*Primary Examiner*—G. L. Kaplan
*Attorney, Agent, or Firm*—Ewan C. MacQueen; Raymond J. Kenny; Francis J. Mulligan, Jr.

[57] ABSTRACT

Nickel forms, such as pellet and shot, are useful as electroplating anode materials; however, due to their small size, it is difficult to retain the nickel forms within conventionally used titanium mesh plating baskets. Nickel forms that have been work flattened are readily retained in conventional anode baskets and provide, in addition, a surprising increase in activity and a desirable coarse residue.

8 Claims, No Drawings

ELECTROPLATING NICKEL USING ANODES OF FLATTENED NICKEL FORMS

The present invention is directed to flattened nickel forms for use as electroplating anode materials.

One of the principal uses for nickel is in the electroplating of baser metal articles to provide a corrosion-resistant and/or decorative surface layer. The methods of nickel electroplating are well known and consist essentially of placing within a bath containing a solution of a nickel salt (e.g., sulfate, chloride, sulfamate, etc.), a nickel anode which is usually contained in a titanium basket, and a cathode or item to be plated. Upon imposing a current between the cathode and the anode, nickel is electrodeposited at the cathode and a fresh supply of nickel ions is provided by the anode.

A nickel plating anode can be prepared by placing pieces of nickel in a titanium anode basket surrounded by a cloth bag. The cloth bag serves to substantially prevent residue, formed at the anode during dissolution, from entering the plating solution. Such residue is undesirable since it can cause a roughened surface to form on the article being plated. The anode basket is generally prepared from titanium mesh or from perforated titanium sheet. Titanium mesh anode baskets can be prepared from expanded metal having a diamond shaped pattern (e.g., having openings from about 3 millimeters × 10 millimeters up to about 15 mm × 30 mm). The mesh size employed in anode baskets used by the U.S. plating industry is normally about 12 mm × 25 mm. Pieces of nickel smaller than about 11 mm in diameter are not readily retained in such baskets.

The form of nickel generally used for electroplating is an electrolytic nickel, for example, in the form of sheared 1.2 × 2.5 × 2.5 centimeter pieces, as well as round, oval, and other shapes (e.g., 25 mm diameter × 5 mm thick as described in U.S. Pat. No. 3,577,330). Such electronickel can contain a supplementary amount of sulfur to render the material electrochemically more active.

The aforedescribed forms of nickel are generally produced by electrolytic means. Another well-known method for producing nickel is the carbonyl nickel process (e.g., as described in U.S. Pat. No. 3,220,875). In the carbonyl process, nickel carbonyl gas is decomposed to provide a spherical nickel product commonly known as pellet nickel. Generally, such pellets have diameters ranging from about 4 mm to about 20 mm. This form of nickel is useful for electroplating applications since it affords a high level of purity; however, special fine mesh baskets are generally required (e.g., 3 mm × 10 mm mesh). Nickel pellets have been flattened by a stamping operation to provide blanks for coinage as described in U.S. Pat. No. 3,131,472. Nickel shot, produced from molten nickel and nickel alloys (e.g., a nickel, 25% iron shot) could also be used for electroplating applications; however, such shot is not commonly used because of the difficulty of retention within conventional anode baskets.

It has now been discovered that flattened nickel forms, e.g., pellet and shot, can be used advantageously as nickel anode materials for electroplating to provide uniform electrodeposits of high purity.

Generally speaking, the present invention is directed to the process of electroplating comprising: immersing in a nickel containing electrolyte an object to be plated and an anode basket containing a work-flattened nickel anode material, said anode material prepared from a nickel form selected from a group consisting of a pellet prepared by a carbonyl nickel process and a shot prepared from a molten nickel alloy bath, the anode material characterized by a capability for retention in the anode basket, increased activity, and provision of a coarser plating residue; and imposing a current between the object to be plated and the anode basket.

The nickel anode material is preferably prepared by a cold rolling operation involving one or more passes in which pellet or shot is fed into two smooth, counter-rotating, power-driven rolls set apart a predetermined distance, preferably from about 0.5 millimeter to about 3 millimeters, e.g., 1.5 millimeters. Generally, the nickel forms contemplated by the present invention have a maximum starting dimension or diameter between about 4 mm and about 24 mm, and preferably between about 6 mm and 20 mm. Still more preferred nickel forms have a maximum starting diameter between about 9 mm and about 16 mm. With nickel forms of less than about 4 mm diameter, insufficient deformation results during cold working to afford the desired retention and unexpected increased activity and coarser residue. With diameters greater than about 24 mm, the forms cannot be readily fed into a rolling mill. Roll surface speeds should be maintained between about 15 and about 40 meters/minute to obtain a uniform product. Roll surface speeds less than about 15 meters/minute impart uneven loading of the rolling mill gear train and are uneconomical. Speeds greater than about 40 meters/minute cause excessive heating of the rolled pieces leading to undesirable oxidation and discoloration of the pieces. The diameter of smooth rolls should be at least about 50 centimeters since smaller diameter rolls will resist introduction of the aforedescribed nickel forms. End plates or other suitable mechanical means are preferred in the rolling mill to maintain the pellet or shot between the rolls.

It has been found expedient to feed the nickel forms to the rolling mill at relatively constant rates, preferably by using a gravity feed tray. To prevent cold welding of adjacent nickel forms during the flattening operation, the surface area of the flattened forms should not exceed about 50% of the surface area of a roll.

The amount of electrical energy required to dissolve a nickel anode material and cause plating to occur at a practical rate is dependent upon the manner of production and the presence of certain activating elements such as sulfur, selenium, silicon, etc. The power requirement is proportional to the electrochemical potential of the anode at a particular current density and in a particular plating solution. For example, comparison of the potentials for electrolytic nickel and nickel containing about 0.02% sulfur as an activator show that sulfur-activated nickel dissolves at a potential about 0.4 volts lower than electrolytic nickel squares at practical plating current densities. This lower electrochemical potential is desirable because it leads to a significant reduction in the power necessary for plating. Flattened pellet also exhibits a lower dissolution potential than electrolytic nickel and unflattened pellet or shot (about 0.1 volt lower).

It is preferred to flatten the pellets by cold working to provide a reduction in thickness of at least about 70%. This degree of cold work is believed to be responsible for an unexpected increase in the particle size of the residue or sludge that forms within the anode compartment as well as for the lower dissolution potential of the flattened pellets. For these same reasons, it is preferred to provide a platelet shape having a ratio of maximum diameter to thickness of at least about 4:1. In this regard, flattened nickel forms according to the invention retain their general elongate shape during dissolution and thereby are retained within an anode basket. In contrast, unflattened nickel forms generally dissolve in a uniform manner so that once they are less than about 11 mm diameter, they are not readily retained within a conventional anode basket.

Although favorable packing density within the anode basket of about 50% is attained through the use of pellet or shot that has been flattened between smooth rolls, in many instances it is desirable to obtain still lower packing densities. Such lower density nickel anode material can be prepared by bending or corrugating the flattened nickel forms. Corrugated and bent nickel forms can be obtained by direct rolling with serrated rolls. A typical serrated roll useful for providing corrugated nickel forms according to the present invention has 1.6 mm high serrations spaced 6.4 mm apart. Serrated rolls can be used as a pair or a single serrated roll can be used in conjunction with a smooth roll.

Since nickel pellet and shot have comparatively high hardness (e.g., typically Rockwell B 84), in a preferred embodiment it has been found expedient to heat treat the pellet and shot for the purpose of softening prior to cold working. Heat treatment is preferably conducted in a neutral or slightly reducing atmosphere at temperatures ranging from about 600° C. to about 800° C. for times ranging from about 15 minutes to about 2 hours. Such treatment softens the pellets and shot considerably (e.g., ½ hour at 800° C. provides Rockwell B 39) which serves to lessen the load on the rolls and rolling mill considerably and substantially increases roll life. Heat treatment at temperatures below about 400° C. does not provide any useful degree of softening. Pellets heat treated at temperatures above 800° C., e.g., 1000° C., are subject to embrittlement which leads to severe cracking during subsequent cold rolling.

Although cold working of pellets and shot can be accomplished by a variety of techniques, such as stamping, forging, and crushing, cold rolling is preferred for economic reasons. Cold rolling provides a desirable structure for the pellet or shot with a capability for varying packing density in the anode basket. The cold rolled nickel forms further provide an interlocking feature which is not necessarily present in particles prepared by techniques other than cold rolling. The technique whereby the nickel forms are worked while warm or hot is considered within the scope of the present invention.

For the purpose of giving those skilled in the art a better understanding of the invention and/or a better appreciation of the advantages of the invention, the following illustrative example is given:

EXAMPLE

A 90-kilogram charge of nickel pellet produced by the carbonyl nickel refining process was subjected to a cold rolling operation. The size of nickel pellets from a representative sample of this charge ranged from about 6 millimeters to about 20 millimeters. Chemical analysis showed that this material contained: 0.010% C, <0.0001% S, <0.0001% Co, 0.0045% Fe, 0.0001% Cu, <0.00002% Zn, 0.0060% O, <0.0005% N, 0.0003% H, and balance Ni.

The pellet was fed via a chute into 52 centimeter diameter × 15 centimeter wide rolls of a K.G. Industries 150 ton M.S. roll compaction machine. This unit provides a maximum linear roll separating force of 1.33 megaNewton at a rated hydraulic pressure of 20.7 megaPascal. The roll gap was set at 0.76 millimeter and the unit operated at a roll speed of 15 rpm. The rate of feeding of the pellets between the horizontal rolls was about 500 grams/minute. The power consumed with this feed rate was between about 36 and 40 horsepower.

Pellets of every size within this sample were readily gripped and flattened by the smooth rolls. It was found that the thickness of the flattened pellet increased with increasing pellet diameter as shown in Table I. Even the smallest flattened pellets were thicker than the 0.76 millimeter roll gap. This was attributed to roll separation as a result of elastic strain in the machine and a design feature of the machine which allows the rolls to separate when the load exceeds rated capacity. The amount of roll separation is dependent to a large degree to the initial roll gap as well as to the feed rate. As a result of introducing pellets of varying diameter at an essentially constant flow rate, a relatively uniform thickness of product is attained due to an "averaging" process.

The cold rolled pellets produced in this test had a good product appearance. The edges of the pellet were smooth and free from cracks. The flattened pellets were generally circular in shape with some ovality indicative of the rolling direction.

To minimize contamination of the electroplating bath from an extraneous source, the cold rolled pellets were subjected to a cleansing procedure prior to the electroplating operation. This involved soaking for 24 hours at 82° C. in an anodic alkaline cleaner, water rinsing and soaking for 2 hours, a dip in 1:1 hydrochloric acid for 2–3 minutes, and a final water rinse.

TABLE I

Average Thickness of Cold Rolled Pellet After Passing Through Rolls With 0.76 mm Gap

| Starting Dia., mm | Final Thickness, mm | Starting Dia., mm | Final Thickness, mm |
|---|---|---|---|
| <6.3 | 1.28 | 11.1 | 1.90 |
| 6.3 | 1.40 | 12.7 | 2.30 |
| 7.9 | 1.45 | >12.7 | 2.10 |
| 9.5 | 1.60 | | |

The flattened pellets were easily loaded into the anode basket. Due to the elongated shape and despite the small size of some of the flattened pellets, they were readily retained within a conventional anode basket that was about 5 centimeters wide × 15 centimeters long × 76 centimeters high and had 12 mm by 25 mm mesh. The packing density of the flattened pellets was 49.3% of theoretical packing density as compared to 56.3% for as-received pellets and 51.8% for electronickel squares. The basket was covered with a duplex anode bag prepared from Dacron* with a Canton flannel cotton liner. The anode basket containing the flattened nickel pellets was placed in a 490 liter Watts bath having a pH of 4 and operating at 57° C. An anode current density of 215 amperes/square meter was maintained on the front face of the anode basket. The cathode was a corrugated mild steel sheet having a surface area of about 0.46 square meter. An identical anode basket filled with 2.5 centimeter × 2.5 centimeter electronickel squares was operated in parallel in the same bath. Anode dissolution proceeded for about three months with periodic anode material replenishment after which the test was terminated and the anode residues collected for analysis.

*Trademark of Dupont

Uniform electrodeposits equivalent in all respects to those achieved with electrolytically refined 2.5 centimeter nickel squares were obtained with the cold rolled pellet. Table II shows the size distribution of residues obtained with flattened pellet, the 2.5 centimeter square electronickel (both tested in conventional titanium anode baskets) as well as that for as-received nickel pellet that was electrodeposited from a minimesh anode basket

TABLE II

Size Distributions, in Weight Percent, of Anode Residues After Dissolution for 3 Months in Titanium Anode Baskets

| Mesh Size | −45 +80 | −80 +140 | −140 +200 | −200 +325 | −325 |
|---|---|---|---|---|---|
| | Basket Residues | | | | |
| Flattened Pellet | 23 | 19 | 11 | 15 | 32 |
| 2.5 cm Electrolytic Squares | 28 | 17 | 10 | 14 | 31 |
| As Received Pellet[1] | 13 | 7 | 6 | 9 | 65 |
| | Bag Residues | | | | |
| Flattened Pellet | 20 | 22 | 11 | 14 | 33 |
| 2.5 cm Electrolytic Squares | 15 | 20 | 13 | 18 | 34 |

[1]Minimesh anode basket was used having a mesh size of 3 mm by 10 mm as compared to conventional mesh size of 12 mm by 25 mm.

The residue from the flattened pellets exhibited approximately the same size distribution as the residue from electrolytic nickel squares. This behavior was considerably different from that exhibited by the as-received pellet which had a larger fine particle fraction (−325 mesh) than the flattened pellet and electrolytic nickel squares.

Although the weight of residue was 0.34% of the total weight of flattened pellet consumed in the three-month test as compared to 0.17% for the electrolytic nickel squares, the rate of dissolution for flattened pellet was about 24% greater than that of the electrolytic nickel squares. The differences in dissolution rates are related to an unexpected increase in the electrochemical activity of flattened pellet associated with the lower dissolution potential in the flattened form.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. The process of electroplating, comprising: immersing in a nickel containing electrolyte an object to be plated and an anode basket containing a work-flattened nickel anode material, said work-flattened nickel anode material having been prepared from a pellet prepared by a carbonyl nickel process or a shot prepared from a molten nickel alloy bath, and said work-flattened nickel anode material being characterized by a capability for retention in said anode basket, an increased activity, and provision of a coarser plating residue; and imposing a current between said object to be plated and said anode basket.

2. The process of electroplating as defined in claim 1, wherein said nickel pellet or shot has a major dimension of about 4 millimeters to about 24 millimeters.

3. The process of electroplating as defined in claim 2, wherein said nickel pellet or shot is cold reduced at least about 70%.

4. The process of electroplating as defined in claim 3, wherein said work-flattened nickel anode material has a ratio of maximum diameter to thickness of at least about 4:1.

5. The process of electroplating as defined in claim 1, wherein said work-flattened nickel anode material has a corrugated pattern.

6. The process of electroplating as defined in claim 1, wherein said nickel pellet or shot has been heated for from about 15 minutes to about 2 hours at temperatures from about 600° C. to about 800° C. prior to work flattening.

7. The process of electroplating as defined in claim 1, wherein said work-flattened nickel anode material is a cold rolled nickel anode material.

8. The process of electroplating as defined in claim 1, wherein said nickel pellet or shot has a major dimension of from about 6 millimeters to about 20 millimeters.

* * * * *